United States Patent [19]

Nakamura et al.

[11] 4,052,588

[45] Oct. 4, 1977

[54] ELECTRIC HEATER PANEL

[75] Inventors: Tatsuji Nakamura, Tokyo; Kenji Fukuda, Asaka; Toshihiko Tsuji, Tokyo; Takeo Maruyama, Yono; Ryouji Sakai; Shohei Sawada, both of Tokyo; Haruki Miyoshi, Toda, all of Japan

[73] Assignee: Nippon Kinzoku Co., Ltd., Tokyo, Japan

[21] Appl. No.: 560,710

[22] Filed: Mar. 21, 1975

Related U.S. Application Data

[63] Continuation of Ser. No. 378,654, July 12, 1973, abandoned.

[30] Foreign Application Priority Data

| | | |
|---|---|---|
| July 29, 1972 | Japan | 47-89480 |
| Apr. 4, 1973 | Japan | 48-40845 |
| Apr. 4, 1973 | Japan | 48-40846 |
| Apr. 13, 1973 | Japan | 48-44424 |

[51] Int. Cl.[2] ..... H05B 1/00; H05B 3/22; F24D 13/00; H01C 3/17

[52] U.S. Cl. ..... 219/345; 219/220; 219/344; 219/353; 219/548; 338/254; 338/293; 338/314

[58] Field of Search ..... 219/342, 344, 345, 353, 219/220, 546–548, 543, 203; 338/206–208, 292, 293, 314, 254, 255, 283

[56] References Cited

U.S. PATENT DOCUMENTS

| | | | |
|---|---|---|---|
| 1,117,128 | 11/1914 | Camm | 219/203 |
| 2,084,556 | 6/1937 | Hamilton | 338/206 |
| 2,458,184 | 1/1949 | Marick | 219/345 X |
| 2,545,805 | 3/1951 | Callender | 219/345 |
| 2,622,180 | 12/1952 | Hodges | 219/345 UX |
| 2,641,675 | 6/1953 | Hannahs | 338/292 X |
| 2,682,596 | 6/1954 | Cox et al. | 338/293 |
| 2,700,095 | 1/1955 | Needham | 219/220 |
| 2,971,073 | 2/1961 | Eisler | 338/212 X |

FOREIGN PATENT DOCUMENTS

| | | | |
|---|---|---|---|
| 255,112 | 3/1963 | Australia | 219/345 |
| 1,233,055 | 5/1960 | France | 219/345 |
| 1,053,753 | 3/1959 | Germany | 219/342 |
| 732,710 | 6/1955 | United Kingdom | 219/543 |
| 496,076 | 11/1938 | United Kingdom | 219/345 |

*Primary Examiner*—A. Bartis

[57] ABSTRACT

A panel heater with a flat metal sheet of substantially even thickness of from 0.06 to 0.2 mm and having a mesh-like radiation section formed in the central portion of the sheet, the mesh-like radiation section being composed of a plurality of units of wave-like current passageways of uniform width of approximately 2 mm from one end to the other, arranged parallel to each other and connected to each other at the crests of the wave-like current passageways so that the combined width of the passageways at the crests is twice the uniform width. The panel heater also has a pair of heat resistant boards between which the metal sheet is sandwiched; and a frame assembly joining together the heat resistant boards.

2 Claims, 2 Drawing Figures

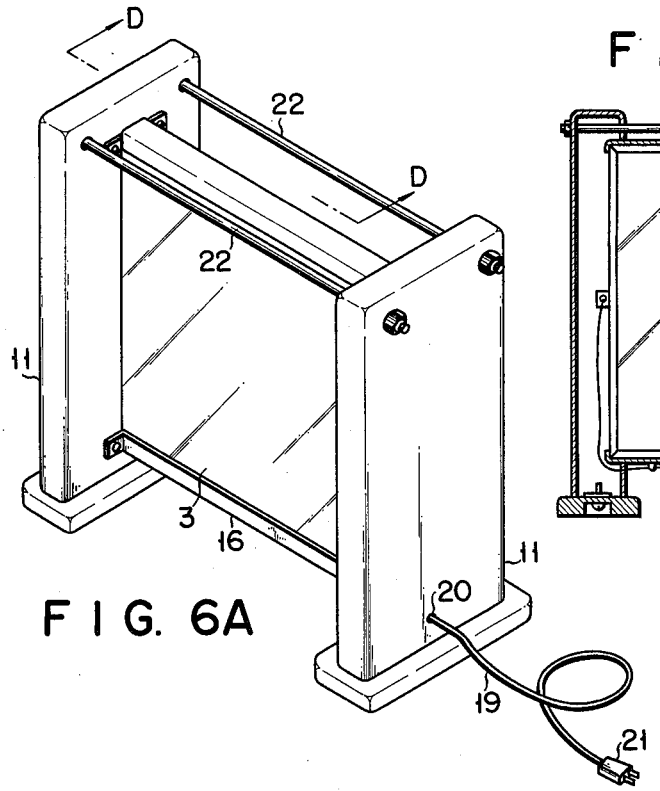
FIG. 6A
FIG. 6B
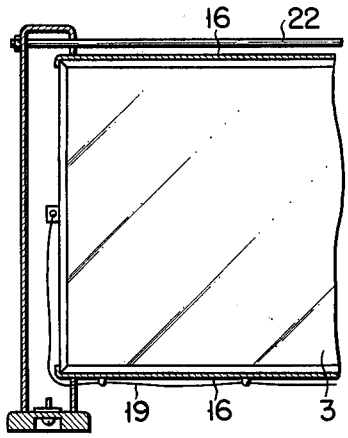
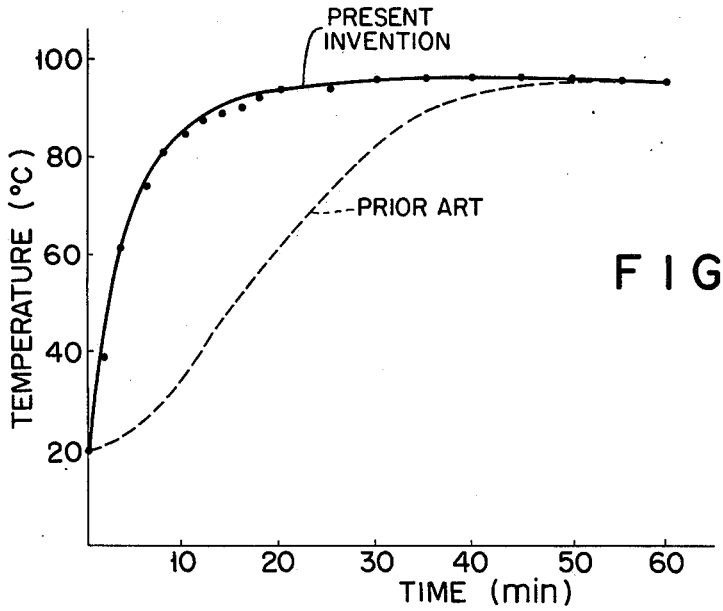
FIG. 7

ELECTRIC HEATER PANEL

This is a continuation, of application Ser. No. 378,654, filed July 12, 1973 now abandoned.

This invention relates to an indoor panel heater. In recent years, a panel heater has come to be widely accepted as means for indoor heating. This type of heater can maintain a broad radiation surface at an appreciably lower temperature (about 80° to 120° C) than obtained from the prior art stoves operated by electric current, petroleum or city gas, thereby providing gentle radiant heat. Accordingly, the panel heater is unlikely to give rise to such accidents as the emission of flames or burning users and can be set close to room walls or furniture, permitting the effective utilization of a larger indoor area to any other purpose than has been possible in the past.

However, heating wire constituting the radiation surface of the conventional panel heater presents difficulties in maintenance and complete insulation, unavoidably resulting in the complicated construction of the panel heater as a whole. With the prior art panel heater, an oil tank is generally provided at the bottom, the oil is heated by the heating wiring and the radiation surface is heated by said hot oil. Therefore, heating of the radiation surface takes a long time and can not be effected efficiently.

This invention has been accomplished in view of the above-mentioned problems and is intended to provide an indoor panel heater which can heat the radiation surface quickly and effectively. The panel heater of this invention comprises a thin metal sheet having a mesh-like radiation section formed at the central area, both crosswise end portions of said thin metal sheet being used as electrode terminals; two transparent heat-resistant boards between which the thin metal sheet is spatially sandwiched; and a frame assembly joining together the thin metal sheet and two transparent heat-resistant boards and defining a large opening in the central area so as to expose those parts of the transparent heat-resistant boards which are spatially superposed on the radiation section of the thin metal sheet.

To describe it in greater detail, the panel heater of this invention comprises a beautiful mesh-like thin metal sheet prepared from stainless steel or aluminum by etching or press work; two transparent heat-resistant boards made of, for example, glass or polycarbonate, between which the thin metal sheet is spatially sandwiched, and whose transparency serves a prominent decorative purpose by exposing the mesh-like thin metal sheet; and a frame assembly joining together the thin metal sheet and the two heat-resistant boards into an integral body (which is hereinafter referred to as a heat element) and defining a large opening in the central area so as to expose the beautiful mesh-like metal sheet through the two transparent heat-resistant boards. The panel heater of this invention is characterized in that the upright members or poles of the frame assembly each contain an illumination means for projecting light on the heat element from its crosswise sides, thereby rendering it more attractive; and/or the frame assembly is further provided with two parallel rods disposed lengthwise of the heat element apart from both upper outer walls thereof so as to dry, for example, wet towels; and/or a plate member disposed above the rods, stretched across the upper ends of the two poles of the frame assembly to join them together and design to receive decorative articles thereon and concurrently to serve a decorative purpose by itself.

This invention can be more fully understood from the following detailed description when taken in connection with reference to the accompanying drawings, in which.

FIG. 6A indicates another modification of the frame assembly where, instead of the table board, two rods are connected to the upper parts of both poles of the frame assembly;

FIG. 6B is a fractional cross sectional view on line D—D of FIG. 6A; and FIG. 7 is a graphic chart showing the relationship of time of power supply and the surface temperature of the heat-resistant boards, comparing the panel heater of this invention with that of the prior art type.

Figure 1:
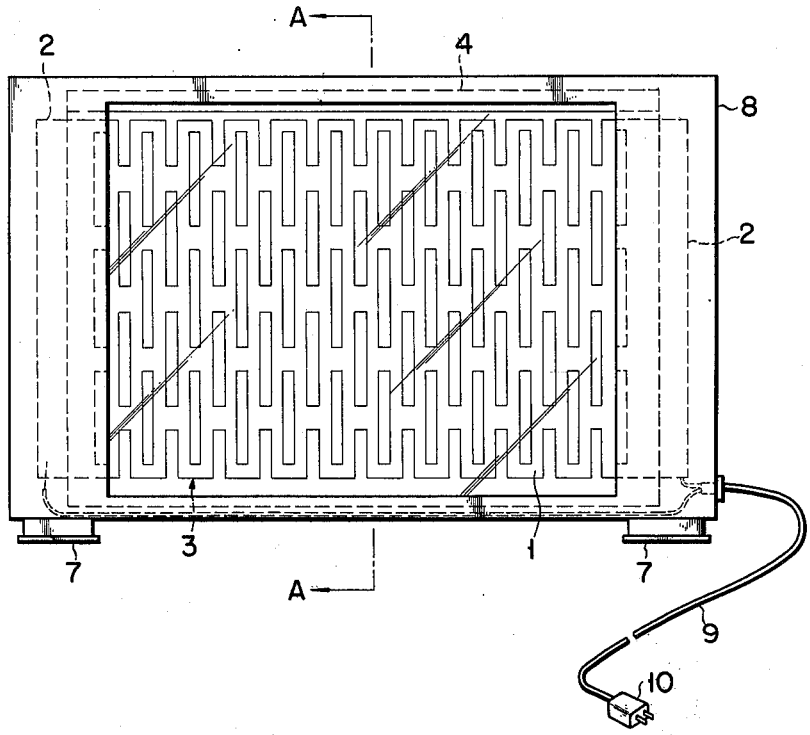
FIG. 1 is a front view of a panel heater embodying this invention.
Figure 2:
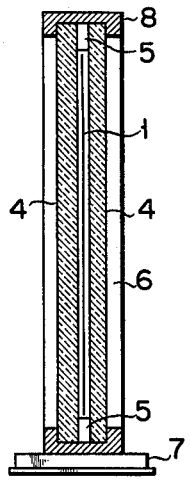
FIG. 2 is a cross sectional view on line A—A of FIG. 1.

There will now be described this invention by reference to the appended drawings. In FIGS. 1 and 2, numeral 1 is a thin metal sheet made of, for example, stainless steel or aluminium. The thin metal sheet 1 has the central portion formed into a mesh-like pattern shown in FIG. 3A or 3B by etching or press punching so as to provide a radiation section, while the ends of the metal sheet 1 form electrode terminals 2.

Figure 3A:
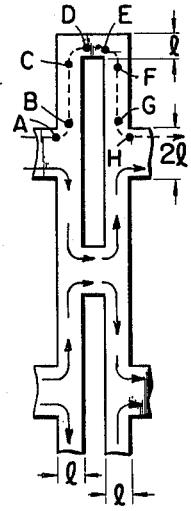
FIGS. 3A and 3B are fractional enlarged views of two different radiation sections of a thin metal sheet useable in said panel heater.
Figure 3B:
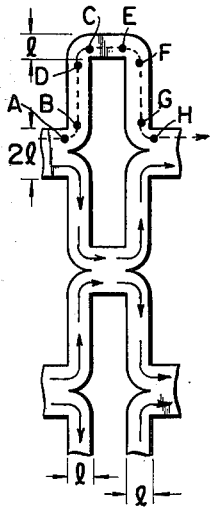

The mesh-like patterns of the radiation sections of FIGS. 3A and 3B are composed of a plurality of units of wave-like current passageways. The pattern of FIG. 3B is advantageous over that of FIG. 3A in that the pattern in FIG. 3B is composed of a plurality of units of current passageways of uniform width from one end to the other, wherein said units are arranged in parallel and connected in a top-to-bottom relationship at each adjacent top and bottom turning point of the respective current passageways. The width of the current passageway in FIG. 3B is kept at "*l*" throughout the length of the passageway, from point A to point H via points B to G, along the dash-line shown in FIG. 3B. The radius at the turning points A, B and C, D and E, F and G, H in FIG. 3B is likewise "*l*". The units are connected to each other at the crests the current passageways so that the combined width "2*l*" of the passageways at the crests is twice the uniform width "*l*". Thus, the heater has a pattern which is equivalent to a heater having straight heating elements of a constant width "*l*". In this way, a uniform temperature over the entire heating element is obtained. This is in contrast to the pattern shown in FIG. 3A wherein the width of the current passageway varies from *l* to 1.4 *l* in the region between A and B, C and D, E and F and G and H as shown in FIG. 3A. This variation in width of the current passageways produces non-uniform temperature over the heating element. The thin metal sheet 1 is spatially sandwiched between two transparent heat-resistant boards 4 made of, for example, glass or polycarbonate. The heat-resistant boards 4 are each higher than the thin metal sheet 1, and spacers 5 slightly thicker than said metal sheet are interposed therebetween. A frame assembly 8 defines a large rectangular opening 6 in the central area and has the bottom ends of the right and left upright members or poles fitted with legs 7. To the frame assembly 8 are fixed the peripheral edges of the heat-resistant boards 4 between which the thin metal sheet 1 is spatially sandwiched. The opening 6 of the frame assembly 8 exposes those parts of the heat-resistant boards 4 which are spatially superposed on the radiation section of the thin metal sheet 1. An integral body consisting of the radiation section of the thin metal sheet 1 and the heat-resistant boards 4 is hereinafter referred to as a heating element 3. One of the poles of the frame assembly 8 is provided with an electric cord 9, to the end of which there is fitted a plug 10 being connected to a power source. In the frame assembly 8, the base portion of the cord 9 is connected to the electrode terminals 2 of the thin metal sheet 1.

Where the thin metal sheet 1 of a panel heater having the above-mentioned arrangement is erected on a flat floor with the legs 7 set thereon, the plug 10 is inserted into the desired power source socket and current is introduced across the electrode terminals 2 of the metal sheet 1 through a current limiting means, then the mesh-like radiation section of the metal sheet 1 is heated because the current passageway of said section has a small cross sectional area with the resultant increase of electric resistivity. Accordingly, radiant heat from said radiation section is released to the outside through the heat-resistant boards 4 and the opening 6 of the frame assembly 8.

According to the above-mentioned embodiment, the meshes of the radiation section of the metal sheet 1 each have such a shape as enables current to flow through every part of the radiation section with a uniform density, so as to heat said radiation section without any irregularities. Further, as previously mentioned, the spacers 5 thicker than the thin metal sheet 1 are interposed between the heat-resistant boards 4 to provide a small gap between the thin metal sheet 1 and heat-resistant boards 4. Therefore, heating of the metal sheet 1 heats the air present between the heat-resistant boards 4, realizing the uniform heating thereof and in consequence the uniform radiation of heat to the outside. The thin metal sheet 1 is not directly fixed to the heat-resistant boards 4, saving them from damage due to the thermal expansion of said sheet 1. The heat-resistant boards 4 consisting of, for example, glass or polycarbonate well serve a decorative purpose, render the panel heater suitable for indoor installation and offer a practical effect of observing the operating condition of the panel heater from the outside.

If necessary, one side of the opening of the frame assembly 8 may be closed. This procedure will offer convenience where a panel heater is placed close to the indoor walls. And provision of a heat reflecting board on that closed side will elevate heat radiation from the opposite side.

If the thin metal sheet 1 has too large a wall thickness, it will present difficulties in forming a mesh-like pattern by etching and also reducing the cross sectional area of the current passageway defined by the radiation section and in consequence obtaining a large amount of heat by increasing the electric resistivity of said current passageway. Therefore, the thin metal sheet 1 is preferred to have a thickness of about 0.06 to 0.2 mm.

Figure 4A:
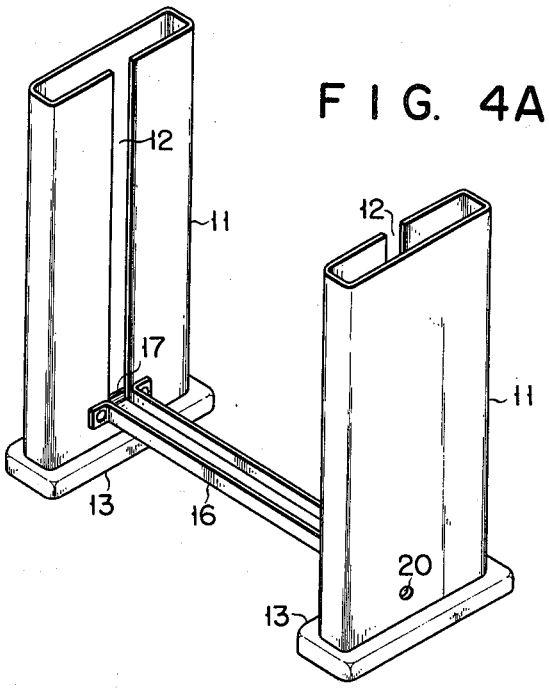
FIG. 4A is a schematic perspective view of a frame assembly containing illumination means with the upper member omitted.
Figure 4B:
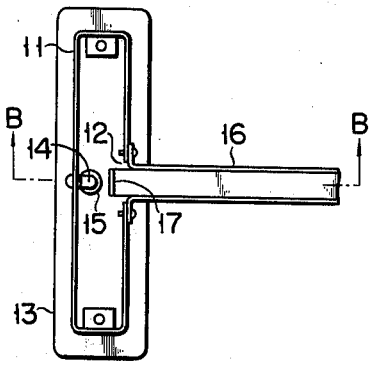
FIG. 4B is a plan view of the same.
Figure 4C:
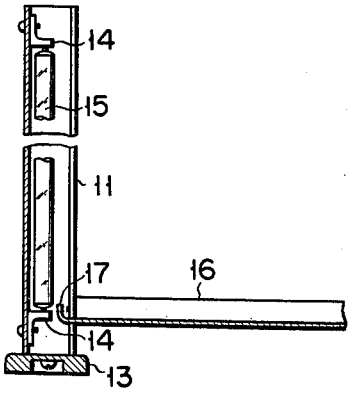
FIG. 4C is a cross sectional view on line B—B of FIG. 4B.
Figure 5A:
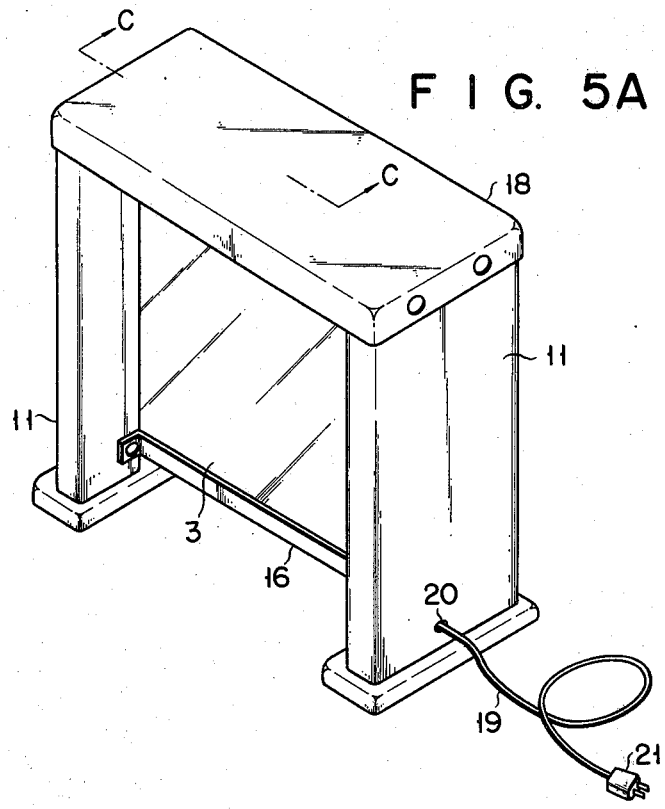
FIG. 5A is a schematic perspective view of a modification of the frame assembly where the upper member of the frame assembly is used as a table board on which articles can be placed.
Figure 5B:
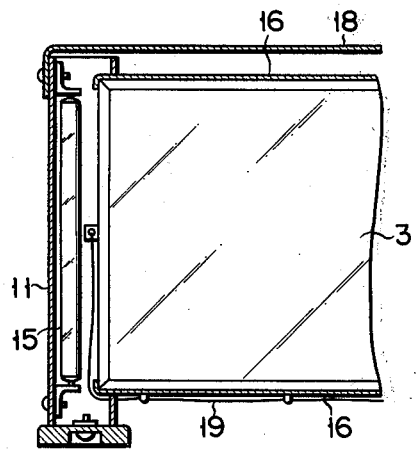
FIG. 5B is *a* fractional cross sectional view on line C—C of FIG. 5A.

There will now be described by reference to FIGS. 4 and 5 the modifications of the frame assembly 8. According to these modifications, the frame assembly 8 consists of the later to be described poles 11, support frames 16 and table board 18. First is described the structure of the frame assembly 8 in the order in which the constituent members are assembled. The two poles 11 rectangular in cross section are made of a metal plate of, for example, stainless steel or aluminium. The mutually facing walls of the poles 11 are each bored with an elongate slit 12 extending for the full length of the poles 11 along the lengthwise central line. The bottom ends of the poles 11 are fitted with rests 13. Each pole 11 has a pair of sockets 14 screwed to the inner walls of the upper and lower end portions. Between the paired sockets 14 is provided an illumination means 15, for example, a fluorescent lamp so as to be aligned with the aforesaid elongate slit 12. To the inner walls of the lower end portions of both remotely spaced poles 11 is screwed a channel-shaped support frame 16 such that the slitted walls of the poles 11 face each other and the opening of the channel-shaped support frame 16 is turned upward. Both end portions of the bottom member of the channel-shaped support frame 16 are inserted into the poles 11 through the slits 12. The inserted parts of the support frame 16 are turned upward substantially at right angles to said bottom member to form bends 17. The facing edges of each slit 12 and the inner wall of the channel-shaped support frame 16 may be provided with a shock-absorbing material, for example, rubber (not shown). The crosswise sides of the heat element 3 including the electrode terminals 2 are inserted into the poles 11 through the slits 12 so as to cause the bottom edge of the heat element 3 to be fitted into the groove of the channel-shaped support frame 16. Another channel-shaped support frame 16 having the same shape and size as the first mentioned support frame is provided across the upper end portions of both poles 11 with the upper edge of the heating element 3 fitted into the groove of said another frame 16 (this time said groove is turned downward), thereby restricting the vertical movement of the heating element 3 whose sidewise movement is limited by the aforesaid bends 17 of both support frames 16. The table board 18 of the frame assembly 8 consists of a rectangular metal plate whose peripheral edge is bent downwardly substantially at right angles, and is fitted to the upper ends of both poles 11. Lead wires 19 connected to the electrode terminals 2 are collected in the bottom end portion of one of the poles 11 and drawn out to the outside through a hole 20 bored in the lower outer wall of said one pole 11 together with or separately from lead wires (not shown) connected to the sockets of the fluorescent lamps 15. The first mentioned lead wires 19 are jointly connected to a plug 21 inserted into a power supply socket.

The above-mentioned arrangement enables the attractive mesh-like radiation section of the thin metal sheet 1 to be observed through, for example, transparent glass plates 4, offering a prominent indoor decorative effect. When a panel heater is set at the center of a room for such decorative purpose, the room will be effectively heated. The panel heater which does not occupy any particular space allows a larger indoor area to be utilized for any other purpose than has been possible in the past. If, in case an external light reflects from the outer surface of the glass plates 4 to conceal the radiation section of the thin metal sheet 1 from view, the fluorescent lamps 15 are actuated, then light therefrom penetrates the glass plates 4 to make the beautiful mesh-like pattern of the radiation section distinctly visible without being affected by indoor illumination from another light source, enabling the panel heater always to display its decorative effect.

In the foregoing modification of the frame assembly 8, its top member, consists of the aforesaid table board 18. However, the provision of such table board 18 is not always required. The frame assembly 8 has only to be of such type as permits the insertion of an illumination means projecting light on the heating element 3 from its crosswise sides.

There will now be described the case where the frame assembly 8 is not provided with any illumination means, but simply has its top member formed of the aforesaid table board 18. This table board 18 enables decorative articles, beverage utensils or smoker's set to be mounted thereon. Further, a panel heater provided with such table board 18 can be concurrently used, if necessary, as a side table. In this case, too, the panel heater allows a larger indoor area to be utilized for any other purpose than has been possible with the conventional panel heater. The table board 18 is simply joined with the poles 11 and does not require the panel heater to have any particularly complicated construction.

The table board 18 may also be formed of a transparent material so as to allow light from the fluorescent lamps 15 to penetrate the table board 18 along the glass plates 4, thereby adding a variety to the indoor decorative effect of the panel heater.

There will now be described by reference to FIG. 6 the case where the frame assembly 8 lacks a top plate and instead has two connections rods 22 extending across the upper end portions of both poles 11 so as to join them together. The connection rods 22 are disposed apart from both upper outer walls of the heating element 3 and may, where required, be used to suspend towels therefrom. This arrangement does not render the construction of the panel heater complicated nor does it require a large number of parts.

A panel heater embodying this invention was experimentally manufactured by forming the thin metal sheet 1 of a stainless steel piece 0.1 mm thick; etching the radiation section (600 mm high and 900 mm wide) of said stainless steel piece into mesh-like pattern in which the current passageway had a width *l* of 2 mm as shown in FIG. 3A or 3B and preparing both heat resistant boards from tempered glass having high heat resistance and flexural strength. The panel heater thus manufactured was heated with the electrode terminal voltage set at 100V and current amperage at 8.3 to 8.25 amp. The surface of the glass boards presented such temperature changes as shown in a table below according to the length of time for which current was introduced. FIG. 7 is a graphic chart showing the relationship of time of power supply and the surface temperature of the heat-resistant boards, comparing the panel heater of this invention with that of the prior art type represented by a broken line. As apparent from FIG. 7, the conventional panel heater required power supply to be continued for about 40 minutes until the generally desired temperature of about 90° Cwas reached, whereas the panel heater of this invention had only to be supplied with power for about 10 to 15 minutes in order to attain substantially the same temperature.

Table 1

| Time of power supply and temperature changes in the panel heater of this invention | | | |
|---|---|---|---|
| Time (min.) | Temperature (° C) | Time (min.) | Temperature (° C) |
| 0 | 20 | 20 | 94 |
| 2 | 39 | 25 | 95 |
| 4 | 64 | 30 | 96 |
| 6 | 74 | 35 | 96 |
| 8 | 82 | 40 | 96 |
| 10 | 85 | 45 | 96 |
| 12 | 88 | 50 | 96 |
| 14 | 89 | 55 | 96 |
| 16 | 90 | 60 | 96 |
| 18 | 92 | | |

As mentioned above, the panel heater of this invention includes a thin metal sheet, the central portion of which is formed into a mesh-like pattern to be used as a radiation section through which current passes. As compared, therefore, with the conventional type whose radiation section is heated by oil previously heated by heating wire, the panel heater of this invention can heat the radiation section more uniformly and effectively in a shorter time.

What we claim is:

1. A panel heater comprising: a flat metal sheet of substantially even thickness of form 0.06 to 0.2 mm; having electrode terminals at two opposite ends of said sheet and a mesh-like radiation section formed in the central portion of said sheet, said mesh-like radiation section being composed of a plurality of units of wave-like current passageways, each unit having a uniform width of approximately 2mm from one end to the other, said units being arranged parallel to each other and connected to each other at the crests of said wave-like current passageways so that the combined width of said passageways at said crests is twice said uniform width; a pair of heat resistant boards between which said metal sheet is sandwiched; and a frame assembly joining together said heat resistant boards.

2. A panel heater according to claim 1 wherein said metal sheet is spatially sandwiched between said heat resistant boards.

* * * * *